US006573872B2

(12) United States Patent
Oberschmidt et al.

(10) Patent No.: US 6,573,872 B2
(45) Date of Patent: Jun. 3, 2003

(54) DUAL-SPIRAL-SLOT ANTENNA FOR CIRCULAR POLARIZATION

(75) Inventors: Gerald Oberschmidt, Bruchsal (DE); Veselin Brankovic, Esslingen (DE); Dragan Krupezevic, Stuttgart (DE)

(73) Assignee: Sony International (Europe) GmbH, Berlin (DE)

( * ) Notice: Subject to any disclaimer, the term of this patent is extended or adjusted under 35 U.S.C. 154(b) by 0 days.

(21) Appl. No.: 09/866,271

(22) Filed: May 25, 2001

(65) Prior Publication Data

US 2001/0048399 A1 Dec. 6, 2001

(30) Foreign Application Priority Data

May 26, 2000 (EP) ..... 00111420

(51) Int. Cl.[7] ..... H01Q 13/10; H01Q 13/12
(52) U.S. Cl. ..... 343/767; 343/769; 343/770
(58) Field of Search ..... 343/767, 768, 343/769, 770, 895; H01Q 13/10, 13/12

(56) References Cited

U.S. PATENT DOCUMENTS 5,465,100 A * 11/1995 Remondiere et al. ..... 343/769
5,914,693 A * 6/1999 Takei et al. ..... 343/767
6,031,503 A * 2/2000 Preiss, II et al. ..... 343/770

OTHER PUBLICATIONS

Nakano H et al: "Experimental Investigation Of Slot Type Dual Spiral Antenna Fed By A Microstrip Line" International Symposium On Antennas And Propagation, US, New York, IEEE, vol.–, Jun. 26, 1989, pp. 1465–1468, XP000079415.

Patent Abstracts Of Japan, vol. 012, No. 077, Mar. 10, 1988, JP 62 216407.

Patent Abstracts Of Japan, vol. 015, No. 148, Apr. 15, 1991, JP 03 024805.

* cited by examiner

*Primary Examiner*—Hoanganh Le
(74) *Attorney, Agent, or Firm*—Frommer Lawrence & Haug LLP; William S. Frommer; Bruno Polito

(57) ABSTRACT

The present invention relates to an antenna comprising a planar dielectric substrate (1) comprising a front (5) and a back dielectric face (6), at least one subantenna means comprising a first (2) and second (3) element for radiating and receiving circular polarized electromagnetic signals, at least one transmission line means (4) for transmitting signals from and to said at least one subantenna means, characterized in that the first (2) and second (3) elements of the subantenna means are slots (2, 3) of a spiral shape and are connected to each other to form a double spiral (9) slot with both spirals (2, 3) having the same sense of rotation, the subantenna means being arranged on the front dielectric face (5) of the substrate and the transmission line (4) means being arranged on the back dielectric faces (6) of the substrate (1). This structure provides a simple configuration which can be produced at low costs and is suitable for the use in a planar array antenna, in particular due to the decoupling of the feed system from the radiating elements.

12 Claims, 6 Drawing Sheets

DUAL-SPIRAL-SLOT ANTENNA FOR CIRCULAR POLARIZATION

Figure 1:
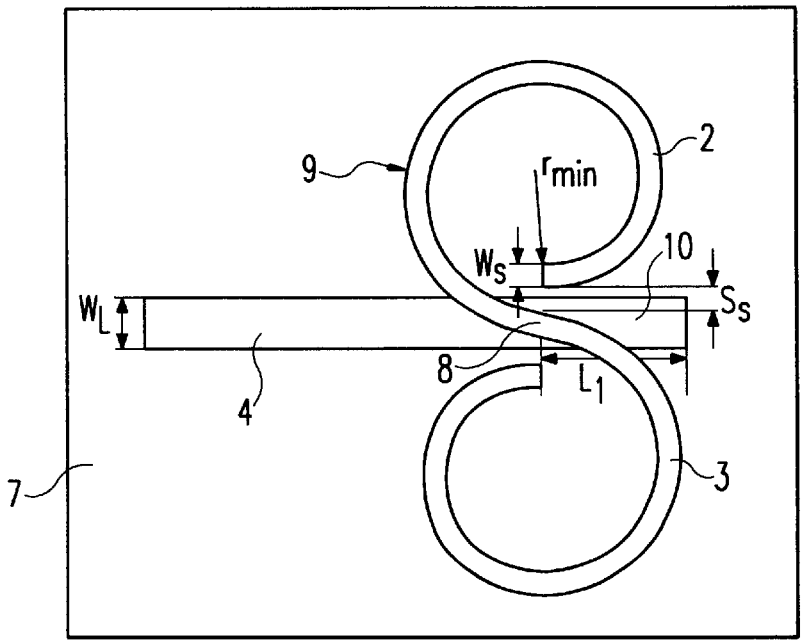

The present invention relates to an antenna for radiating and receiving circular polarized electromagnetic signals in particular signals with microwave or mm-wave frequencies.

Such antennas are of particular interest for high data rate applications. Typical applications of that type are satellite-earth-communication, indoor LOS, wireless LANS or outdoor LOS private links. These applications require large bandwidths which can only be granted in very high frequency regions as e.g. from 15 GHz to 60 GHz. The circular polarization is necessary in order to omit the requirement for the user to observe the orientation of the antenna.

Antennas for the use in this field of application have been described in the prior art. In EP 0 481 048 B1 for example a microstrip radiator for circular polarization is described. This antenna comprises a substrate on which a radiating patch element is located, the patch element is separated from a conductive layer surrounding the patch by a slot and is connected to the surrounding conductive layer by a spiral band. An input strip is provided on the opposite side of the substrate. In this antenna the radiating element is the path and the wire like spiral band. The slot is not considered to be a radiating element.

The object of the present invention is to provide an antenna which allows applications into the mm wave frequencies within a very large band width with good efficiency, which has a high gain and is simple in structure.

This object is achieved by an antenna comprising, a planar dielectric substrate comprising a front and a back dielectric face, at least one subantenna means comprising a first and second element for radiating and receiving circular polarized electromagnetic signals, at least one transmission line means for transmitting signals from and to said at least one subantenna means, characterized in that the first and second elements of the subantenna means are slots of a spiral shape and are connected to each other to form a double spiral slot with both spirals having the same sense of rotation, the subantenna means being arranged on the front dielectric face of the substrate and the transmission line means being arranged on the back dielectric face of the substrate.

The main advantages of the antenna according to the present invention are its simple structure and the decoupling of the feed network from the radiating structure. Finally with the antenna according to the present invention a higher gain than with other types of antennas can be achieved.

The simplicity of the structure is given by the fact that the feed line and the subantenna means are both formed on one single dielectric substrate on opposite sides thereof. For the inventive arrangement, hence, already a single layer substrate suffices. An additional alignment of a path on an upper layer is therefore not required. Such alignments are mandatory for aperture coupled patch path antennas. The tolerance is very small for high frequencies and therefore such an alignment is a tedious task. The possibility of omitting such an alignment during manufacturing of the antenna allows the use of cheaper technology and thereby decreases the overall costs. The simple structure and low costs are a strong necessity for a commercial success of an antenna and are met by the inventive structure.

According to the present invention the subantenna means and the transmission line are arranged on a dielectric substrate, which preferably has a dielectric constant of $\epsilon_1 \geqq 1$. Suitable material for the dielectric substrate is for example Teflon-fiberglass with a dielectric constant of 2.17. The subantenna means are dual-spiral slot which are preferably formed in a metal coated area on one of the faces of the dielectric substrate. They can be obtained by metallizing one side of the substrate and etching the slots into the metallic layer by known etching techniques. The feed structure is obtained by applying metal to the opposite side of the substrate in the desired shape. Both the feed structure and the slots can be produced by using well known photo etching or thick film processing or the like.

With the feed line, which may have an additional feed network, being arranged on the opposite side of the substrate from the subantenna means it is ensured that the feed structure is decoupled from the radiating spiral slots and that radiation of the antenna is only determined by the subantenna means, namely the radiating spiral slots, which are well controllable.

The shape of the radiating elements of the subantenna means is that of a spiral. The spiral slots are arranged such that the outer end of one spiral is connected to the outer end of the other spiral, so that a long slot is formed. By arranging the sense of rotation of the two spirals to be equal an even radiation pattern of the antenna can be achieved.

The length of the dual-spiral slot is crucial to the operation. It is normally chosen in order to allow for a traveling wave, which radiates while traveling from the connection of the two spirals, which is as will be described later, to the end of the spiral. The length should be chosen such that the average current density is constant through out the slot.

Further advantageous features of the antenna according to the present invention are defined in the subclaims.

The spirals which form the slots for radiating the signals can have less than one, one or multiple spiral turns. The choice of the geometry of the spiral slots offers the possibility to vary the length of radiating slots to be formed. Also the area covered by the subantenna means and thereby the overall antenna size can be adjusted by the appropriate choice. It is not necessary to design the spiral slots such that the spiral is open at the end. The antenna according to the present invention can also be operated with a subantenna means comprising two closed loops. Furthermore not each of the spirals has to be formed by a slot bent to the desired rounded shape. The open or closed spiral can also be realized by a rhombic like structure. In the later case the turns of the spiral will not be smooth but will have edges.

Elements of the subantenna means of any of the described shapes are attached to each other to form a long slot. The connection between the two spiral slots can be achieved by simple attaching the end of the spiral slot that extends outwards to the respective end of the other slot. In a preferred embodiment the first and second element of the subantenna means are, however, connected via a small linear coupling section. This section also is formed by a slot. The angle between the coupling slot and the beginning of the spiral slots can be within the range of 0 to 90°. If two open spirals are connected via a straight coupling section under an angle of 0° the overall slot results in an S-shape. The spirals are always connected to each other in a way as to avoid an overlapping of the two spirals. Furthermore the spiral slots must not be arranged in such a way that a part of the turn of the spiral or a whole turn crosses the projection of the feed line, which is arranged on the opposite side of the substrate. Such an overlap would result in an unwanted coupling.

The coupling slot in contrast has to be positioned such that the projection thereof crosses the feed line. Also if no straight coupling slot between the two spirals is provided the coupling of the dual spiral slot to the feed line preferably takes place close to or at the center of the slot. In a preferred embodiment the section of the dual spiral slot, where the feed line and the subantenna means overlap in their projection, is perpendicular to the direction of the feed line. This way an equal distribution of power between the two spirals can be expected which leads to an even radiation pattern of the antenna.

If the coupling section of the dual-spiral slot is not perpendicular to the feed line direction the power will be unevenly distributed between the two spirals. In that case the electric field strength in one of the spirals is much higher than in the other spiral. This phenomenon can be compensated by adjusting the length of the respective spiral slots. The antenna of the present invention can therefore also be designed such that the first or the second element of the subantenna means is greater in length than the other. The spiral with the shorter length would then be used as the spiral at the side where the higher power supply occurs due to the position of the coupling section of the dual-spiral slot.

Another way of compensation for the uneven power distribution is by designing the antenna geometry such that the two spirals have different radii. The smaller the radius of the spiral, the smaller the electric field strength in the spiral slot will be.

It is also within the scope of the invention that the spirals have a varying radius over the turn. Finally the slot forming the spirals can be of an even width over the length or the width can increase in each of the two spirals forming the dual-spiral slot. In the latter case the width preferably increases from the coupling section to the end of each slot.

Besides the possibility of compensating unequal power distribution between the two spirals it has to be noted that the length of each spiral and the radius of its turn must be adjusted appropriately in order to allow the forming of a circular polarized wave. In the antenna according to the invention the exciting wave is guided to the slot area through the microstrip feed line. Here the magnetic field component excites an electric field within the slot. The length and radius have to be chosen such that a phase difference of 90° is introduced between the magnetic field component at the vertical and the horizontal parts of the spirals. This leads to a phase shift of 90° between the radiated vertical and the horizontal electric field components. Due to this phase shift a circular polarized radiation at the correct frequency of operation can be obtained.

The antenna according to the present inventions can advantageously further comprise a reflector means. This reflector means which is normally represented by a reflector plate is spaced to and parallel with the back face of the dielectric substrate. Between said reflector means or plate and said back face of the substrate, low loss material should be located. Even though the inventive antenna can be operated without any reflector means, such means can be added in order to enlarge the broadside gain of the antenna and to cancel the backside radiation. The reflector plate is preferably spaced from the middle of the substrate on which the feed line is located in a distance of ¼ λ, wherein λ is the center frequency of operation.

The inventive antenna is in particular suitable for being arranged as an antenna element in a phase antenna array comprising a plurality of antenna elements. The planar phase antenna array can be obtained by arranging several subantenna means each including a dual-spiral slot on one substrate and feeding this arrangement by means of a feeding network, located on the opposite face of the substrate. In such an arrangement the advantage of the present invention specifically come to fruition. The arranging of the feed line on the opposite side of the substrate from the subantenna means provides a possibility of decoupling of the feed network from the radiating structure. With conventional antennas, in particular in array configuration, spurious unwanted radiation components are observed from the feed network. These components greatly decrease the axial ratio and are therefore undesirable. In the antenna according to the present invention in contrast the feeding network is completely decoupled from the subantenna means and thus the radiation is only determined by the well controllable subantenna means, namely the radiating dual-spiral slots.

In a preferred embodiment the feeding network for such a planar phase antenna array is realized by tapered microstrips. By the use of tapered microstrips no quarter wave transformers have to be used.

Figure 2:
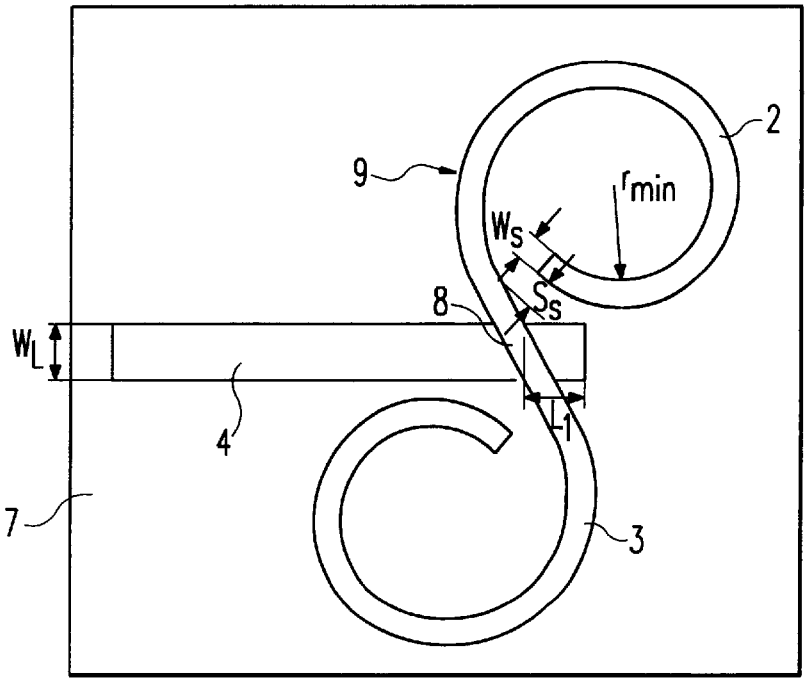
Figure 3:
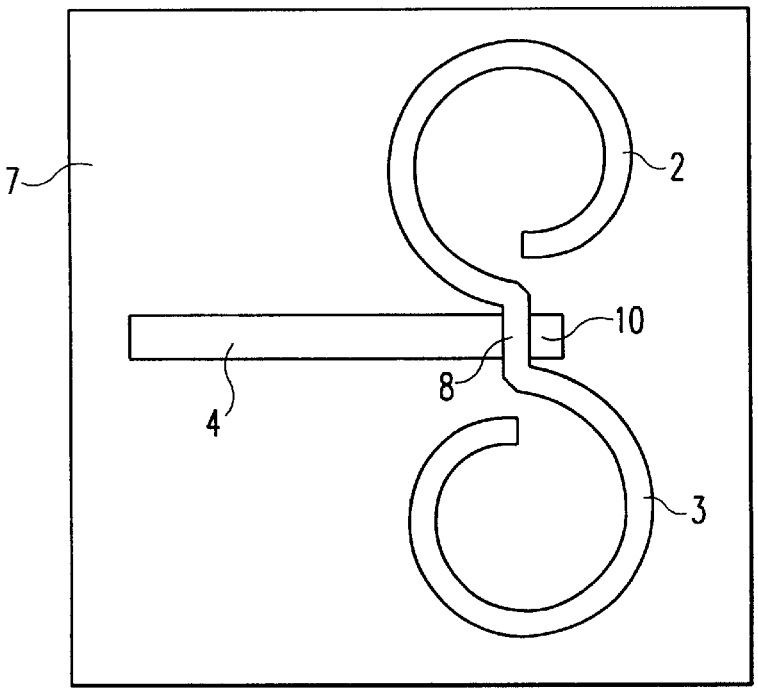
Figure 4:
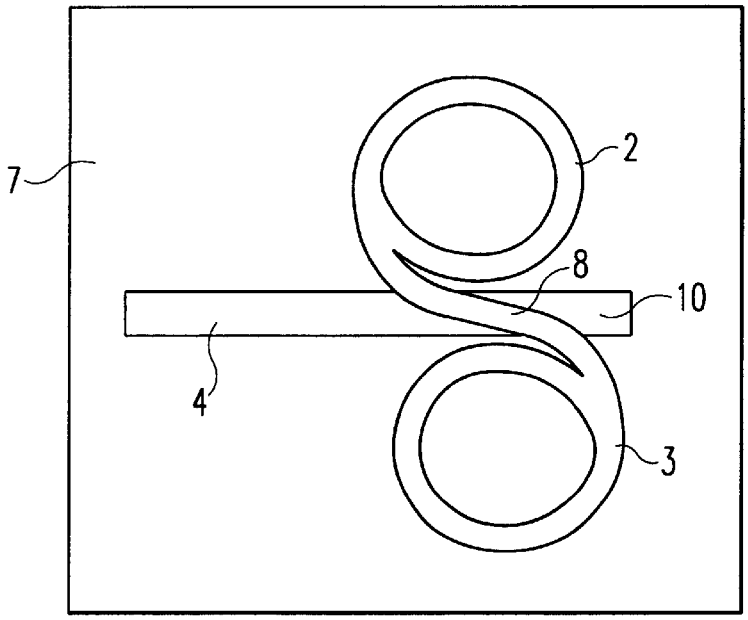
Figure 5:
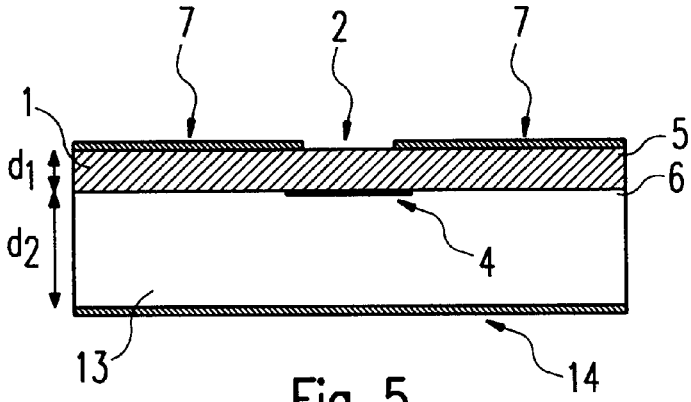
Figure 6:
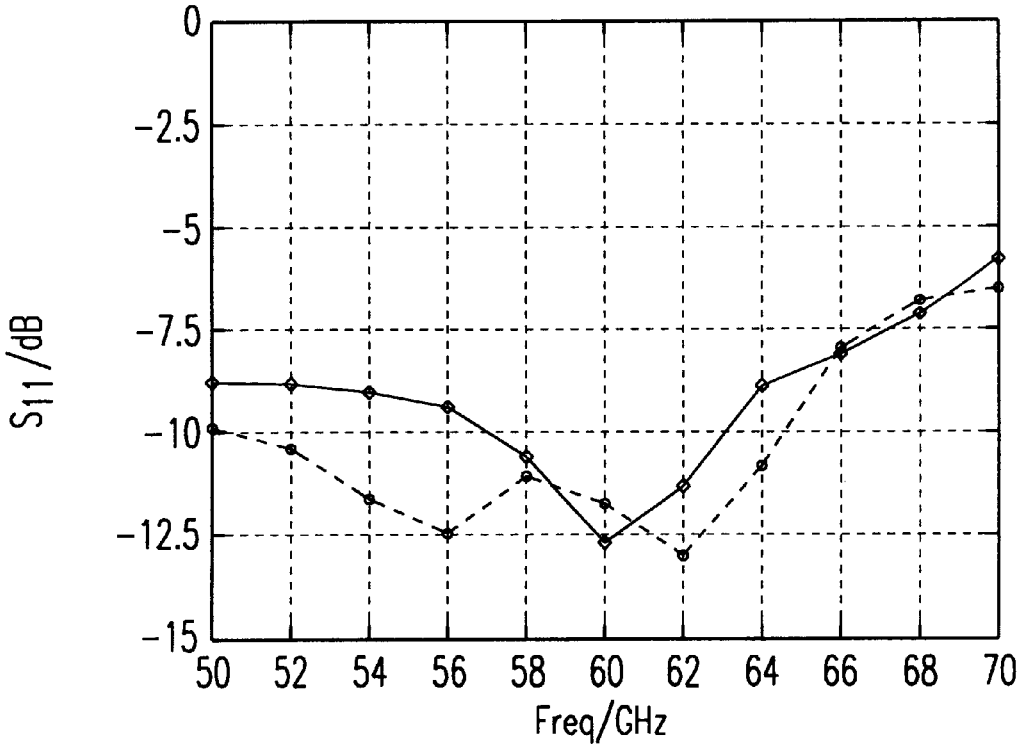
Figure 7:
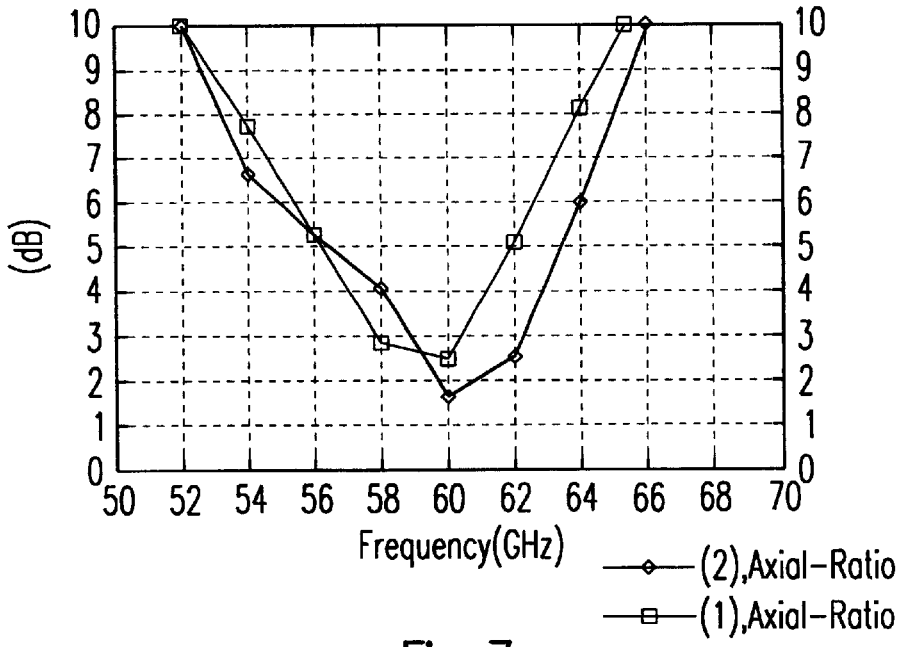
Figure 8:
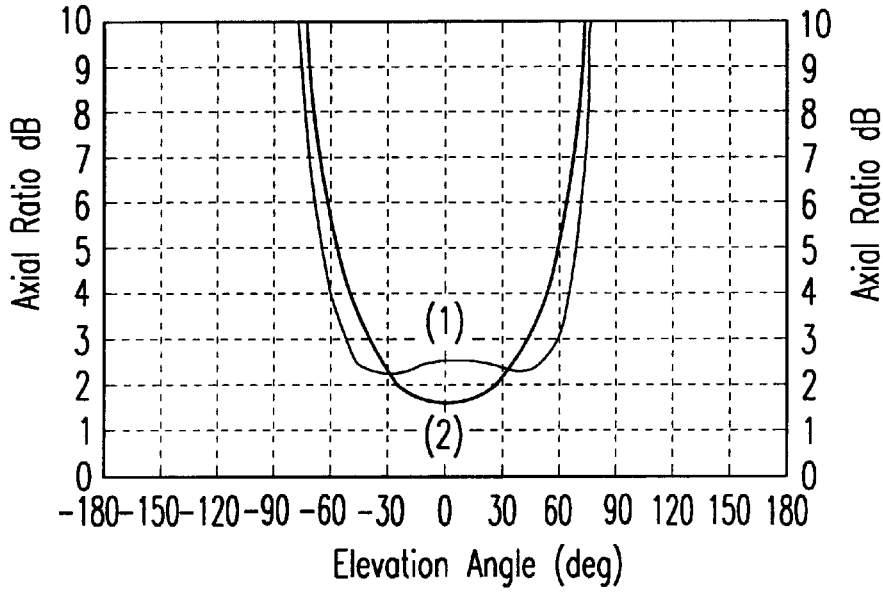
Figure 9:
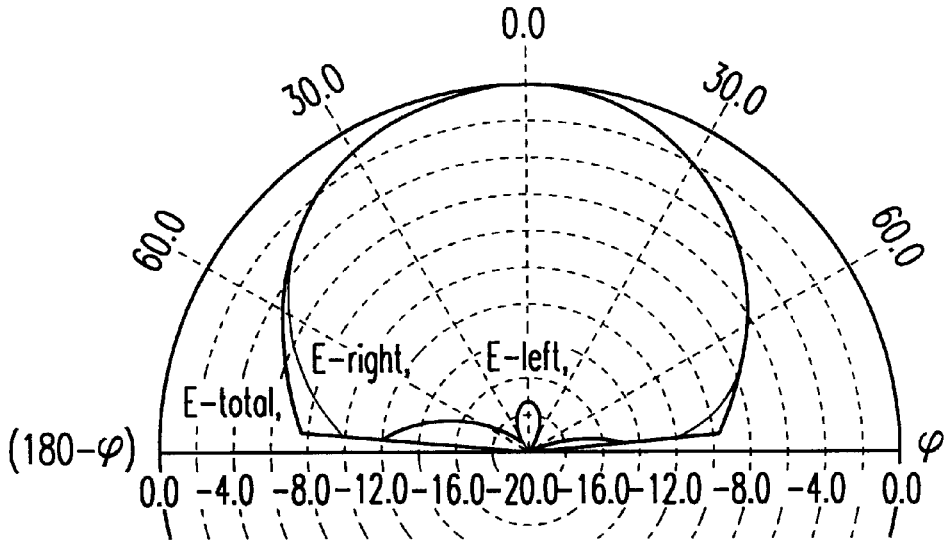
Figure 10:
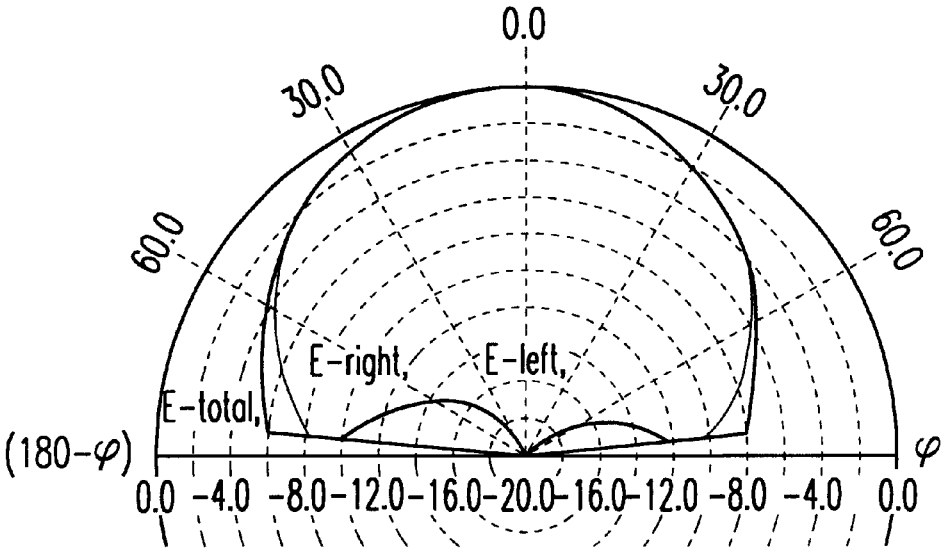
Figure 11:
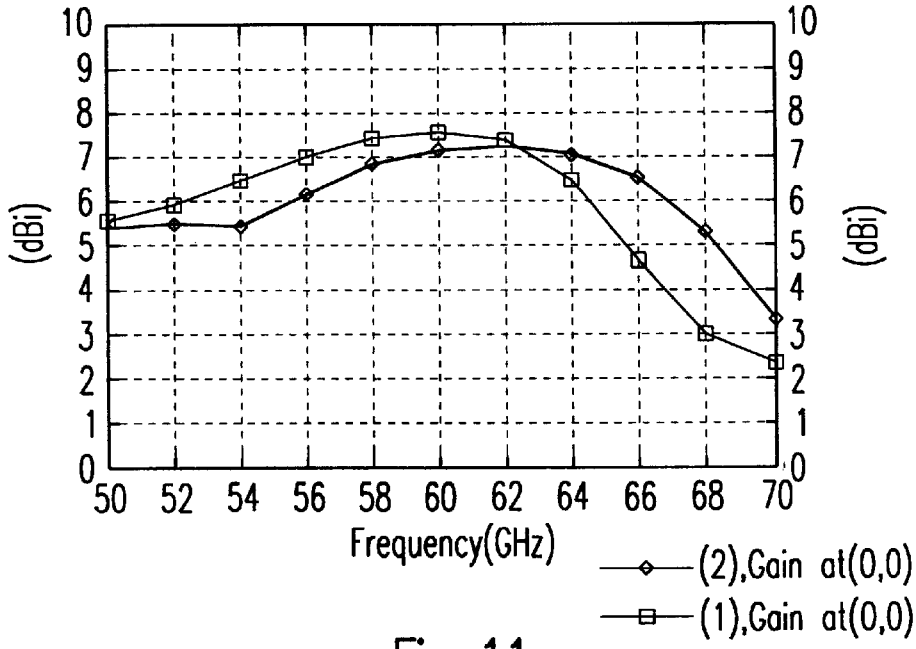
Figure 12:
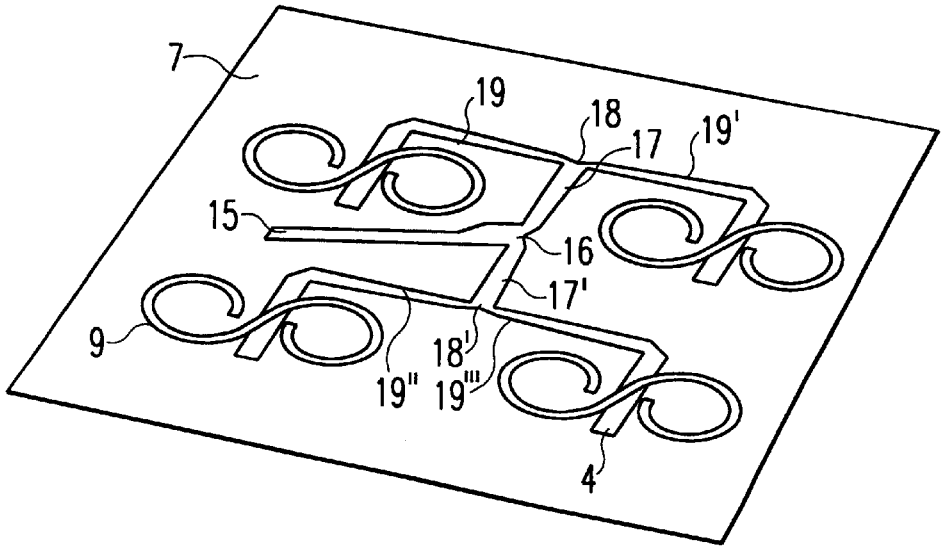

The present invention will in the following be explained in more detail by means of a preferred embodiment with reference to the enclosed drawings, wherein FIG. 1 shows a schematic top view of a first embodiment of the present invention, FIG. 2 shows a schematic top view of a second embodiment of the present invention, FIG. 3 shows a schematic top view of a third embodiment of the present invention, FIG. 4 shows a schematic top view of a fourth embodiment of the present invention, FIG. 5 shows a schematic cross-sectional view of an antenna according to the present invention, FIG. 6 shows a simulation result of the antenna return loss versus the frequency, FIG. 7 shows a simulation result of the axial ratio in the main direction of an antenna according to present invention versus the frequency, FIG. 8 shows a simulation result of the axial ratio versus elevation angle, FIG. 9 shows a simulation result of a normalized radiation pattern of an antenna according to the present invention at 60 GHz, FIG. 10 shows a simulation result of a normalized radiation pattern of another antenna according to the present invention at 60 GHz, FIG. 11 shows a simulation result of the gain of the antenna in the main direction versus the frequency, FIG. 12 shows an array configuration with inventive antennas as antenna elements.

FIG. 1 shows a schematic top view of an antenna according to the present invention, with a projection of spiral slots 2, 3 on a front face 5 and feed line 4 on a back face 6 of a dielectric substrate 1 in a common plane. In the antenna according to the present invention the slots 2, 3 can be formed on the front face 5 of the dielectric substrate 1 by etching a metallic layer 7, which had been applied to the front face 5 of the substrate 1. The slots 2 and 3 are spiral slots connected to each other to form a dual-spiral slot 9. In the example shown in FIG. 1 the spiral slots 2 and 3 are connected on their outward facing ends via a linear coupling slot 8. This coupling slot 8 has the same width as each of the spiral slots 2 and 3. The spiral slots 2 and 3 represent open spirals with a radius $r_{min}$ of their turn. The distance between one turn of a spiral and the following turn of the spiral is indicated as $S_s$. The angle between the ends of the spirals 2, and 3 and the coupling slot 8 is approximately 0°. The dual-spiral slot 9 therefore has an S-shape.

On the opposite side of the substrate 1 a feed line 4 for guiding the exciting wave to and from the dual-spiral slot 9 is provided. In the embodiment of FIG. 1 the feed line 4 is a microstrip feed line with a constant width $W_L$. The feed line 4 is arranged as to pass underneath the dual-spiral slot 9 approximately at its center, i.e. where the linear coupling section 8 is located. The angle between the direction of the coupling slot 8 and the direction of the feed line 4 can be different in different embodiments of the invention. In the embodiment shown in FIG. 1 the angle is very small almost 0°, so that the coupling section 8 and the feed line 4 are almost parallel. Due to this small angle the power supplied to the antenna will not be equally distributed between the two spirals 2 and 3. In the shown embodiment the electric field will be much higher in the bottom spiral 2 than in the upper spiral 3. The feed line 4 extends over the center of the dual-spiral slot 9. The portion by which the feed line extends in that direction is referred to as the stub 10. The length of the stub 10 can be adjusted in order to minimize the imaginary part of the complex impedance in the coupling plane. This way the antenna structure can be effectively matched to the characteristic impedance of the feed line, which can for example be 50Ω. The end of the feed line 4 opposite to the stub 10 can be connected to a feeding network. With the inventive antenna no hybrids or power dividers are required for the feeding network.

The total length of the dual-spiral slot 9 is approximately one guided wave length in the dual-spiral slot 9. This length as well as the width Ws of the dual-spiral slot 9 or the width of each of the spirals 2 and 3 individually can be adjusted in order to yield the correct real part of the impedance of the coupling and to yield the correct phase angle of the field components for a circular polarized wave.

In FIG. 2 a second embodiment of the invention is shown wherein the coupling section 8 is at a specific angle to the feed line 4. The length of the coupling section 8 is slightly bigger than in FIG. 1. Normally the length of the coupling section or slot 8 should be kept as small as possible in order to minimize unwanted radiation from it. It is however a further requirement for ideal antenna performance that the inner section of a spiral 2 or 3 should not cross the feed line 4, as this would lead to unwanted coupling which would disturb the operation. With the angle chosen between the coupling section 8 and the feed line 4 the length of the coupling section 8 has to be bigger in order to avoid the undesired coupling from the inner sections of the spirals 2 and 3. The further measures of the dual-spiral slot 9 are as shown in FIG. 1. In this embodiment however the stub 10 of the feed line is shorter to match the antenna structure to the characteristic impedance of the feed line 4.

Also in this embodiment the power supplied to the antenna will not be equally distributed between the two spirals 2 and 3. In the shown embodiment the electric field will be much higher in the bottom spiral 2 than in the upper spiral 3.

In FIG. 3 a schematic top view of a third embodiment of the present invention is shown wherein the coupling section 8 is perpendicular to the feed line 4. In order to avoid overlapping of the inner sections of the spirals 2 and 3 with the feed line 4, the angle between the outer end of spirals 2 and 3 and the coupling section 8 is almost 90°. With this arrangement the power will be evenly distributed and also with spirals 2 and 3 having the same width and length, the strength of the electric field will be the same in both spirals 2 and 3.

In FIG. 4 a schematic top view of a fourth embodiment of the present invention is shown wherein the coupling section 8 is similar to the section of the first embodiment. The spirals 2 and 3 of the fourth embodiment are however closed spirals.

In FIG. 5 a cross-sectional view of an antenna according to the invention is shown. The substrate 1 is covered on its front face 5 by a metallic layer 7. In this layer spiral slots 2 and 3 are located (only slot 2 is shown in FIG. 4). On the opposite side of the substrate 1, the back dielectric face 6 the feed line in form of a microstrip line 4 is shown. The feed line is preferably a metallic line which is applied to the back face 6. It is however also within the scope of the invention to form the feed line 4 by a slot in a metallic layer applied to back face 6.

The embodiment shown in FIG. 5 is a preferred embodiment wherein the dielectric substrate is supported by a low-loss material 13, on the opposite side of which a reflector means 14 in form of a metal reflector plane is located. The low-loss material 13 can be polyurethane, a free space filled with air or some other low-loss material with a dielectric constant close to 1 preferably less than 1.2. The reflector means 14 serve to enlarge the broadside gain of the antenna. For this purpose the distance of the reflector plane to the back face of the dielectric substrate 1 can be adjusted accordingly. The distance $d_2$ between the reflector means 14 and the middle of the dielectric substrate 1 is preferably about one fourth of the electrical wave length λ of the central frequency (middle of the working band).

All the embodiments shown in FIGS. 1 through 5 are suitable for the use as an antenna element in a phase array antenna configuration. In FIG. 12 a possible array configuration with four antenna elements according to the invention and as shown in FIG. 1 is given. The dual-spiral slots 9 are arranged in a two by two formation on the front face 5 of a substrate 1. The feeding of the dual-spiral slots 9 is carried out by a feeding network which is located on the back face 6 of the substrate 1. In the feeding network tapered feed lines are used. The feeding network can have various configurations. In the feeding network as shown in FIG. 12 a first line 15 splits into two branches by means of a T-junction 16 which is located in the center of the array configuration. From this first T-junction 16 two lines 17 and 17' leave to end in two respective T-junctions 18, 18', where they are again split up in lines 19, 19', 19" and 19"'. These last lines are perpendicularly connected to the feed lines 4 of the dual-spiral slots 9. The lines from the T-junctions to the succeeding T-junctions are tapered to provide an impedance transformation in the succeeding T-junction located in the direction of the dual-spiral slots 9. The width of said lines increases towards the dual-spiral slots 9. Also the lines from the last T-junctions to the feed lines 4 are tapered in this manner whereby the lines are matched to the feed lines 4.

In order to show the performance of the inventive antenna and the influence of the radius of the spirals on the performance, tests have been carried out. An antenna as shown in FIG. 1 is considered with two different setups. The first antenna (1) was designed to have symmetric setup and the second antenna (2) had an asymmetric setup.

In both antennas (1) and (2) the width of the feed line 4 was set to be $W_L$=0.4 mm, with a characteristic impedance of 50Ω. The width of the dual-spiral slot 9, including the coupling section 8, was 0.2 mm and the separation between one turn and another $S_s$=0.2 mm. The substrate 1 used for both antennas had a thickness of $d_1$=0.127 and a dielectric constant of $\epsilon_r$=2.2. In both antennas a reflector plate 14 was located at a distance $d_2$=1.4 mm from the back face 6 of the substrate 1.

For antenna (1), the inner radius of both spirals was $r_{min}$=0.6 mm and for antenna (2) the radii were $r_{min}$=0.6 mm for the lower and $r_{min}$=0.525 mm for the upper spiral 2 and 3, respectively.

A manual optimization showed best results at 60 GHz for the antennas with the above mentioned parameters.

In FIG. 6 the input reflection coefficient S11 in dB versus the frequency in GHz is shown. The solid line indicates the results for antenna (1) with the symmetric setup, whereas the dash-dotted line represents the results for antenna (2) with the asymmetrical setup. From this graph it can be derived that the input reflection coefficient is much lower for the asymmetric antenna (2) than for the symmetric antenna (1). This antenna (2) also shows a very broadband performance. The comparatively high value of −12 dB is due to the low impedance in the coupling region, which leads to a real part of the output impedance of about 30Ω in the coupling plane. In order to achieve a lower reflection coefficient well-known broadband matching techniques can be used. For example the width $W_s$ of the dual-spiral slot as well as the length of the spiral slots can be adjusted to obtain a correct real part of the impedance in the plane of coupling.

FIG. 7 shows the axial ratio in the main direction of an antenna according to present invention over the frequency. The main direction is perpendicular to the plane of the substrate. In this direction the axial ratio for antenna (1) is below 3 dB between 58 and 60.5 GHz. For the asymmetric antenna (2) it is even more broadband from 59 to 62.5 GHz. The additional advantage of the present invention becomes obvious with regard to FIG. 8, where the axial ratio is shown versus the elevation angle parallel to the feed line. The wide angular range of circular polarized operation of the antenna according to the invention extends from −50° to +60° for the 3 dB range of the antenna (1) and from −40° to +45° for the asymmetric configuration of antenna (2). The wide angular range of the antennas can also be derived from FIGS. 9 and 10 where the radiation patterns (normalized, in dB) of the antennas at 60 GHz are indicated. It can be seen that the main mode is right circular and the left circular component is below −16 dB in the range of interest.

In FIG. 11 the gains in the main direction obtained with antennas (1) and (2) are shown. Both antennas have a gain of above 6 dBi for broadside operation in the frequency range of interest.

With the inventive antenna hence a high gain and a broadband performance can be achieved, while the manufacturing of the antenna is simple and involves comparatively low costs.

What is claimed is:

1. An antenna comprising:

a planar dielectric substrate (1) comprising a front (5) and a back dielectric face (6), at least one subantenna means comprising a first (2) and second (3) element for radiating and receiving circular polarized electromagnetic signals, at least one transmission line means (4) for transmitting signals from and to said at least one subantenna means, characterized in that the first (2) and second (3) elements of the subantenna means are slots (2, 3) of a spiral shape and are connected to each other to form a double spiral (9) slot with both spirals (2, 3) having the same sense of rotation, the subantenna means being arranged on the front dielectric face (5) of the substrate and the transmission line (4) means being arranged on the back dielectric face (6) of the substrate (1);

wherein the direction of the double-spiral subantenna means (9) at the section, where the feed line (4) and the subantenna means (9) overlap in their projection, is not perpendicular to the direction of the feed line (4); and whereby the first or the second element of the subantenna means is greater in length than the other.

2. The antenna according to claim 1, characterized in that the first and second element (2, 3) of the subantenna means are of a spiral shape that has less than one turn.

3. The antenna according to claim 1, characterized in that the first and second element (2, 3) of the subantenna means are of a shape of a closed spiral turn, forming a closed loop.

4. The antenna according to claim 1, characterized in that the first and second element (2, 3) of the subantenna means are of a spiral shape realized by a rhombic structure.

5. The antenna according to claim 1, characterized in that the first and second element (2, 3) of the subantenna means are connected via a straight coupling section (8).

6. The antenna according to claim 1, characterized in that the first and second element (2, 3) of the subantenna means (9) are of a spiral shape wherein the radii of the first and second spiral are different.

7. The antenna according to claim 1, characterized in that the first and second element (2, 3) of the subantenna means (9) are of a spiral shape wherein the radius of the spiral turn varies.

8. The antenna according to claim 1, characterized in that the width of each of the first and second element (2, 3) of the subantenna means (9) varies over the length.

9. The antenna according to claim 1, characterized in that the antenna further comprises a reflector means (14) being spaced to and parallel with the back face (6) of the dielectric substrate (1), with low loss material (13) being located between said reflector means (14) and said back face (6) of the substrate (1).

10. The antenna according to claim 9, characterized in that the reflector means (14) are spaced from the middle of the substrate by a quarter wave length of the center frequency of operation.

11. The antenna according to claim 1, characterized in being arranged as an antenna element in a phase antenna array comprising a plurality of antenna elements.

12. The antenna according to claim 11, characterized in that the transmission means are connected to a feeding structure, which comprises tapered microstrips (17, 19).

* * * * *